US008393464B2

(12) United States Patent
Yang et al.

(10) Patent No.: US 8,393,464 B2
(45) Date of Patent: Mar. 12, 2013

(54) MULTIFUNCTIONAL CASE FOR PORTABLE ELECTRONIC DEVICE BACKGROUND

(75) Inventors: Hsin-Yung Yang, Tu-Cheng (TW); Li-Houng Lu, Tu-Cheng (TW); Ching-Min Lin, Tu-Cheng (TW); Tzu-Cheng Yu, Santa Clara, CA (US)

(73) Assignee: Chi Mei Communication Systems, Inc., New Taipei (TW)

( * ) Notice: Subject to any disclaimer, the term of this patent is extended or adjusted under 35 U.S.C. 154(b) by 0 days.

(21) Appl. No.: 13/082,546

(22) Filed: Apr. 8, 2011

(65) Prior Publication Data

US 2012/0181195 A1 Jul. 19, 2012

(30) Foreign Application Priority Data

Jan. 18, 2011 (TW) ..... 100101716 A

(51) Int. Cl.
*B65D 25/20* (2006.01)

(52) U.S. Cl. ..... 206/45.2; 206/320

(58) Field of Classification Search ..... 361/679.01; 312/223.2; 206/320, 576, 722, 724, 45.25, 206/45.2, 45.23, 45.24, 45.26, 767, 768, 206/45.28, 45.29, 754, 755
See application file for complete search history.

(56) References Cited

U.S. PATENT DOCUMENTS

2004/0240164 A1* 12/2004 Lee ..... 361/683
2006/0285283 A1* 12/2006 Simonian et al. ..... 361/679
2009/0236246 A1* 9/2009 Ai ..... 206/320
2010/0089778 A1* 4/2010 Park ..... 206/320
2010/0122924 A1* 5/2010 Andrews ..... 206/320

OTHER PUBLICATIONS

Patently apple:"Apple's Ipad case Design is now Registered with Patent Office", Patentlyapple.com (Aug. 2, 2010).

Squirrel, "Origami Ipad Sleeve From Incase," Gaygadget (Nov. 4, 2010).

* cited by examiner

*Primary Examiner* — Jacob K Ackun
*Assistant Examiner* — Jenine Pagan
(74) *Attorney, Agent, or Firm* — Altis Law Group, Inc.

(57) ABSTRACT

A multifunctional case includes a base, a cover, and a foldable connecting area connecting the base to the cover, the base defines a receiving space in a front surface for receiving a flat-type electronic device. The cover is substantially the same size as the base and includes a first plate portion, a foldable second plate portion connected to the first plate portion, two foldable third plate portions connected to two sides of the first plate portion, and two foldable fourth plate portions connected to two sides of the second portion. The third plate portions are respectively connected to the fourth plate portions. The cover is foldable relative to the base, the connecting area, and the first through fourth plate portions can cooperatively fold to support the base in a slanted position so that the electronic device is supported in a slanted position.

17 Claims, 6 Drawing Sheets

MULTIFUNCTIONAL CASE FOR PORTABLE ELECTRONIC DEVICE BACKGROUND

BACKGROUND

CROSS-REFERENCE TO RELATED APPLICATIONS

This application is related to co-pending U.S. patent applications (application Ser. No. 13/036,116), entitled "MULTIFUNCTIONAL CASE FOR PORTABLE ELECTRONIC DEVICE". Such applications have the same assignee as the present application. The above-identified applications are incorporated herein by reference.

Technical Field

This disclosure relates to cases for portable electronic devices, particularly, to a multifunctional case for protecting and supporting portable electronic devices.

On one hand, cases are widely applied to protect portable electronic devices. On the other hand, users generally need a holder for supporting the portable electronic device, for example to read an eBook or watch video. However, it can be difficult to carry the case and the holder at the same time. In many cases, the holder can be easily left behind after use.

Therefore, there is room for improvement within the art.

BRIEF DESCRIPTION OF THE DRAWINGS

Many aspects of the multifunctional case can be better understood with reference to the following drawings. The components in the drawings are not necessarily drawn to scale, the emphasis instead being placed upon clearly illustrating the principles of the multifunctional case.

DETAILED DESCRIPTION

Figure 1:
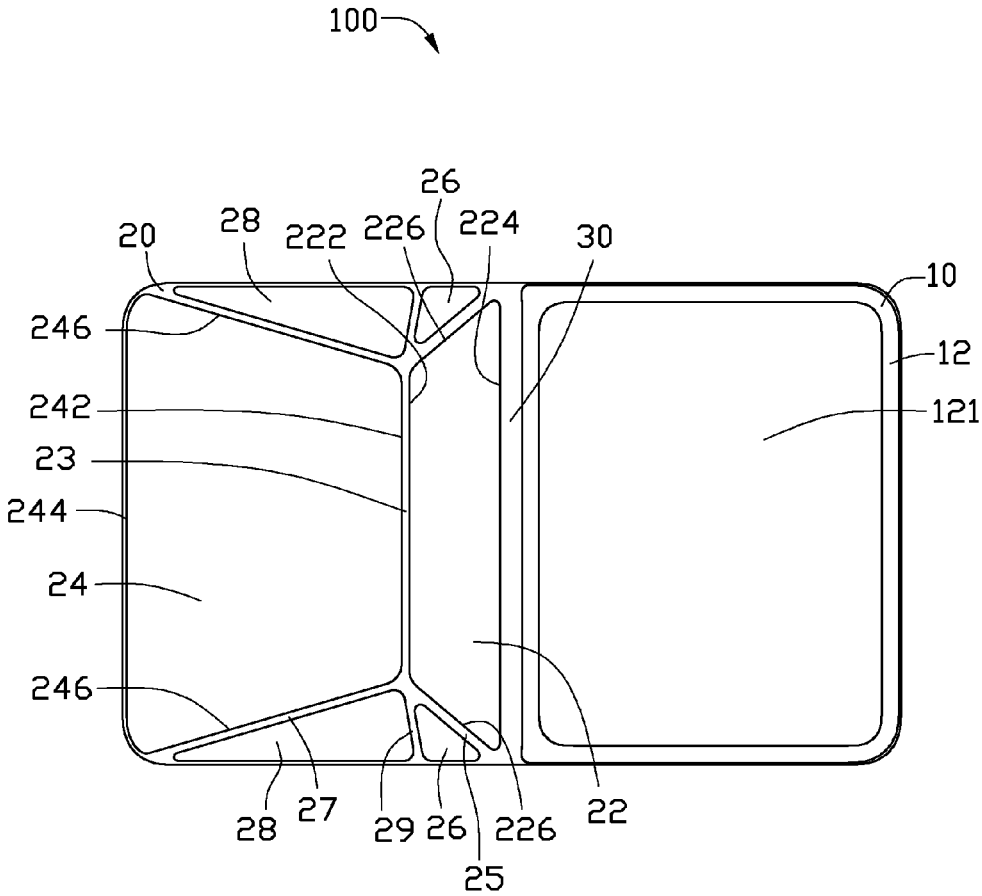
FIG. 1 is a frontal view of an unfolded multifunctional case as disclosed.

FIG. 1 shows an unfolded multifunctional case 100 for receiving and supporting an electronic device with panel shaped structure such as a tablet computer, liquid crystal display television (LCD-TV), etc. The multifunctional case 100 includes a base 10, a cover 20 foldable relative to the base 10, and a connecting area 30 connecting the base 10 with the cover 20.

Figure 2:
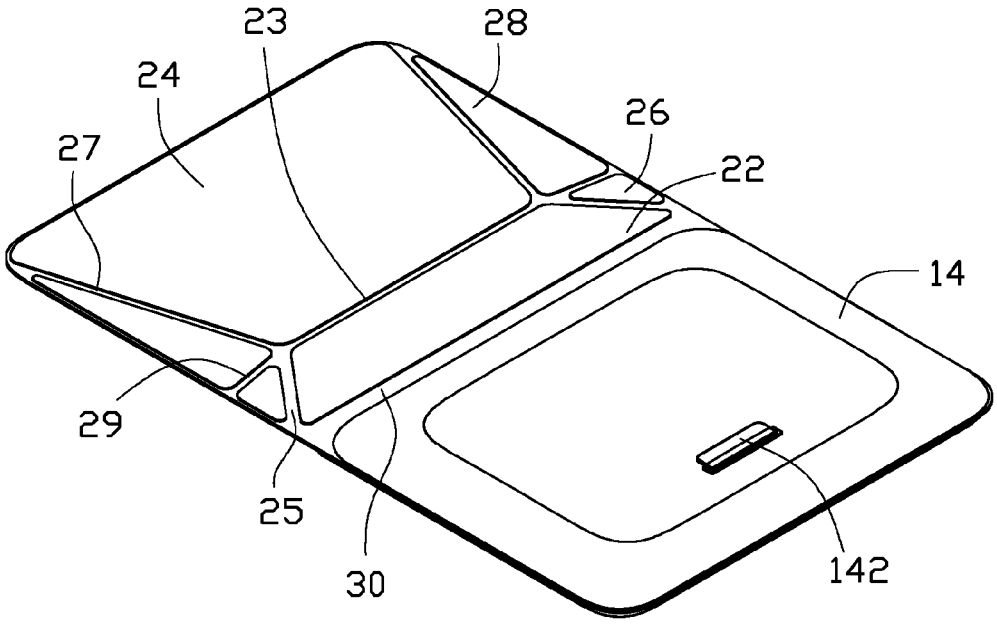
FIG. 2 is a back view of the unfolded multifunctional case shown in FIG. 1.

The base 10 defines a receiving space 121 in a front surface 12. The receiving space 121 receives and latches the electronic device. Referring to FIG. 2, the base 10 forms a latching portion 142 such as a latching piece on a back surface 14 of the base 10. The latching portion 142, located near the middle of the back surface 14 and parallel with the connecting area 30, is elastic for easy latching of the cover 20.

The cover 20 has substantially the same size as the base 10. The cover 20 can rotate around the connecting area 30 to cover the base 10. The cover 20 includes a first plate portion 22, a second plate portion 24, two third plate portions 26, and two fourth plate portions 28. The first through fourth plate portions 22, 24, 26, 28 can be made of plastic materials such as polycarbonate. The first plate portion 22 and the second plate portion 24 are isosceles trapezoid shaped and have a first folding area 23 between them. The first plate portion 22 can be folded with respect to the second portion 24 along the first folding area 23. The first plate portion 22 has an upper margin 222, and a bottom margin 224 parallel with the upper margin 222. The upper margin 222 is adjacent to a side of the first folding area 23, and the bottom margin 224 is adjacent to a side of the connecting area 30.

The second plate portion 24 has an upper edge 242, and a bottom edge 244 parallel to the upper edge 242. The upper edge 242 is adjacent to the side of the first folding area 23 opposite to the upper margin 222. The bottom edge 244 is adjacent to the outer side of the cover 24.

The two third plate portions 26 are triangular and are located at two sides of the first plate portion 22. Each third plate portion 26 forms a second folding area 25 connecting to the first plate portion 22. The third plate portion 26 can be folded with respect to the first plate portion 22 along the second folding area 25.

The two fourth plate portions 28 are triangular and located at two sides of the second plate portion 24. Each fourth plate portion 28 forms a third folding area 27 connecting to the second plate portion 24. The fourth plate portion 28 can be folded relative to the second plate portion 24 along the third folding area 27. Each fourth plate portion 28 forms a fourth folding area 29 connecting to the third plate portion 26. The fourth plate portion 28 can be folded relative to the corresponding third plate portion 26 along the fourth folding area 29.

The connecting area 30 can be made from fibrous materials and plastic materials such as polyurethane. All of the folding areas 23, 25, 27, 29 can be made from the same materials as the connecting area 30. The cover 20 can cover and protect the base 10 when received in the receiving space 121, while the first plate portion 22, the second plate portion 24, the two third plate portions 26, and the two fourth plate portions 28 are remain unfolded.

Figure 3:
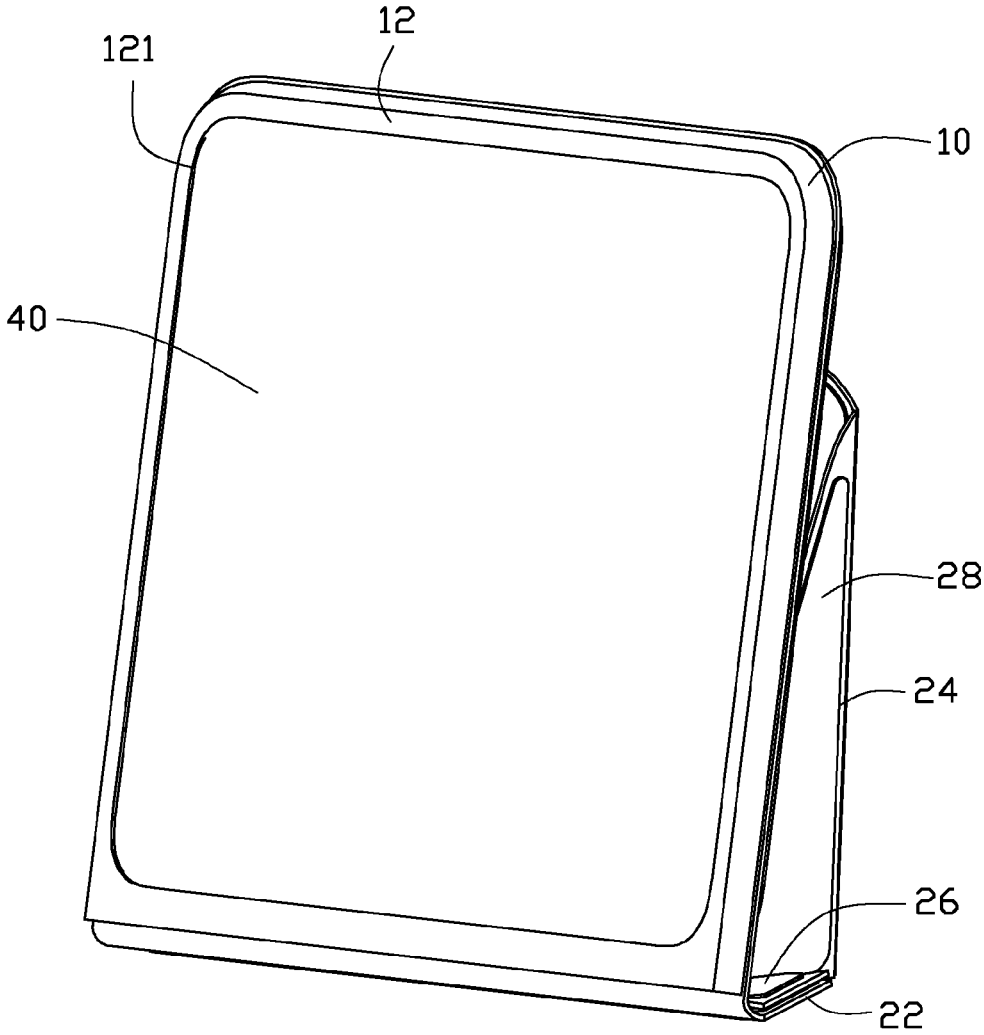
FIG. 3 is a front view when the multifunctional case is folded for the purpose of receiving and supporting an electronic device for viewing.
Figure 4:
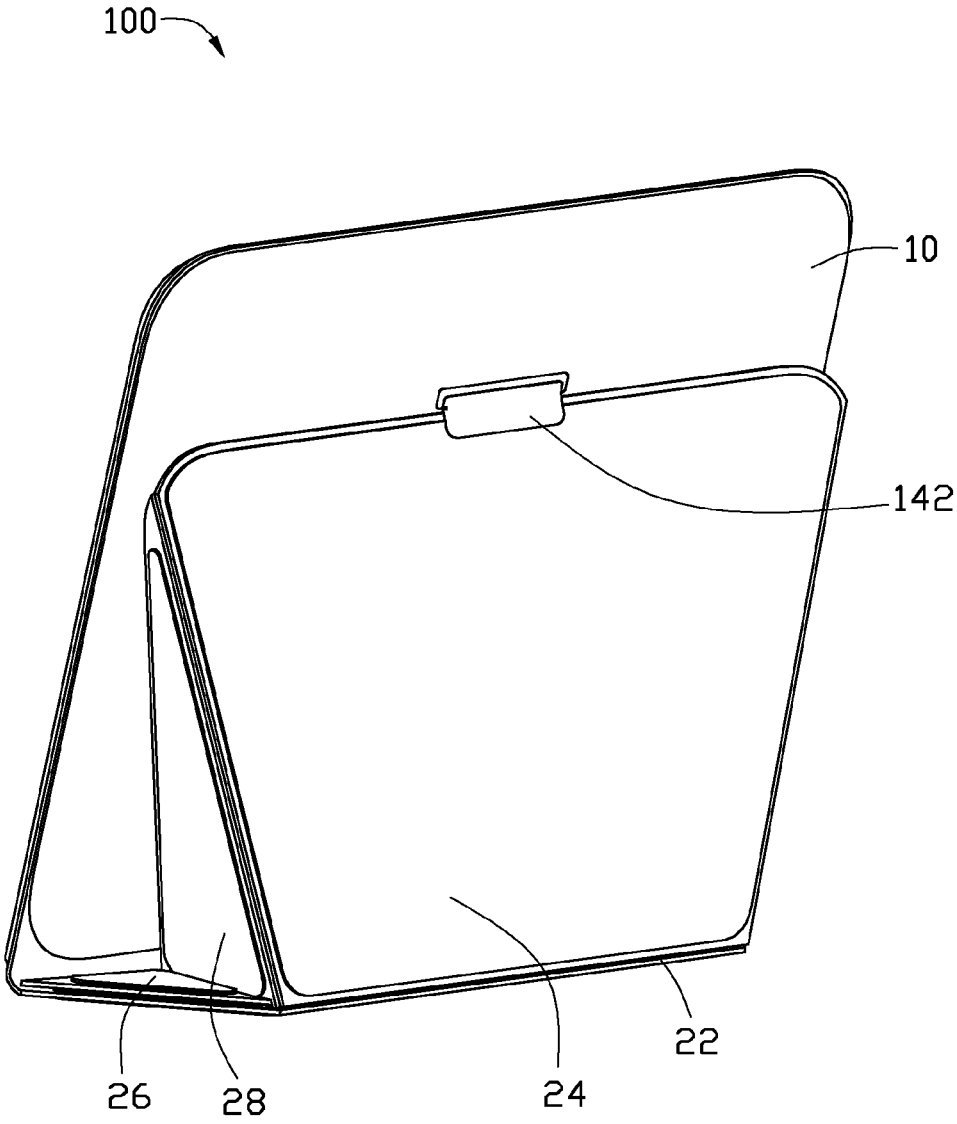
FIG. 4 is a back view of FIG. 3.

Referring to FIGS. 3 and 4, for achieving an oblique angle of view for a received electronic device 40, the cover 20 can be opened relative to the base 10 and further folded to cause the first plate portion 22 to fold towards the back surface 14 of the base 10 along the connecting area 30. The second plate portion 24 folds relative to the first plate portion 22 along the first folding area 23 until the outer side of the cover 20 latches to the latching portion 142. Each third plate portion 26 is folded towards the first plate portion 22 along the second folding area 25 and abuts against the first plate portion 22. Each fourth plate portion 28 is folded towards the second plate portion 24 along the third folding area 27. Thus, the third plate portions 26 and the fourth plate portions 28 cooperatively support the second plate portion 24. The second plate portion 24 rests against the back surface 14 of the base 10, and the base 10 can stand steadily on a platform (not shown) in a slanted orientation. In this orientation, the electronic device 40 can be viewed comfortably.

Figure 5:
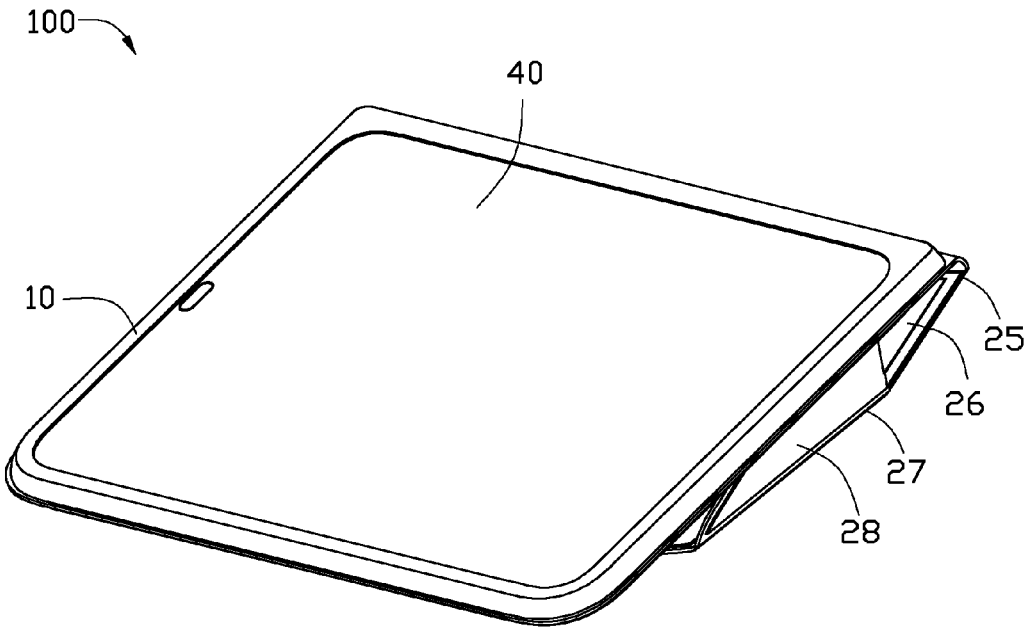
FIG. 5 is a schematic view when the multifunctional case is placed in a position for supporting the electronic device when writing on it.

FIG. 5 shows an orientation where the first plate portion 22 is lowered towards the platform and the third folding area 27 steadily rests against and on the platform. At this orientation, the display 42 of the electronic device 40 can be used more comfortably.

Figure 6:
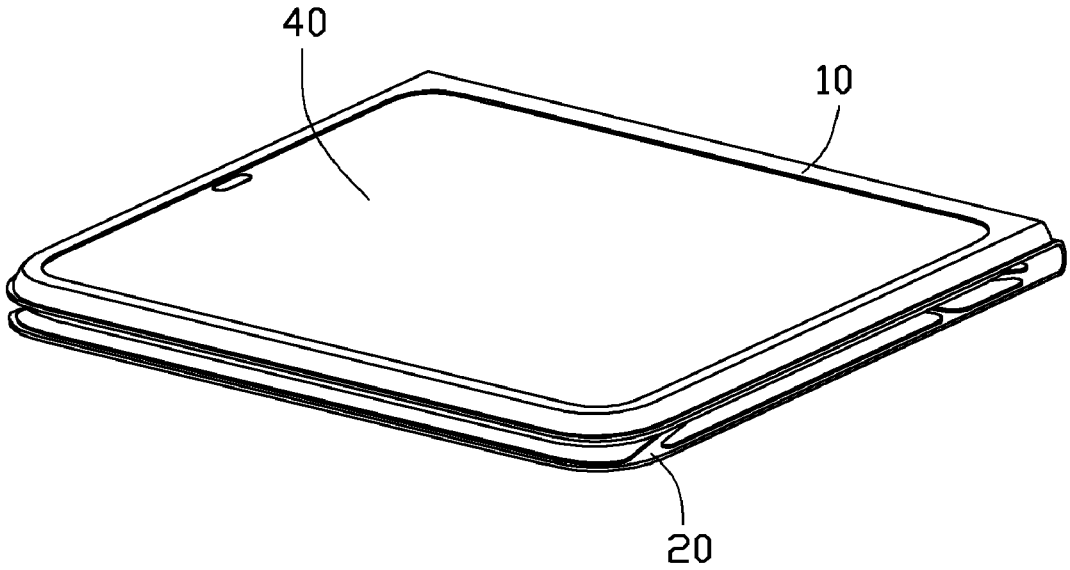
FIG. 6 is a substantially folded view of the multifunctional case with the electronic device exposed.

FIG. 6 shows an orientation when the cover 20 is opened and parallel to the base 10. The electronic device 40, if received in the receiving space 121, is exposed to the outside for viewing. Meanwhile, the first plate portion 22, the second plate portion 24, the two third plate portions 26, and the two fourth plate portions 28 are maintained unfolded It is to be understood that even though numerous characteristics and advantages of the present exemplary embodiments have been set forth in the foregoing description, together with details of structures and functions of various embodiments, the disclosure is illustrative only, and changes may be made in detail, especially in matters of shape, size, and arrangement of parts within the principles of the disclosure to the full extent indicated by the broad general meaning of the terms in which the appended claims are expressed.

What is claimed is:

1. A multifunctional case for receiving or supporting a portable electronic device, comprising:

a base defining a receiving space in a front surface for receiving the electronic device and having a latching portion on a back surface;

a cover having substantially the same size as the base, the cover including a foldable first plate portion connected to the base, a foldable second plate portion connected to the first plate portion, two foldable third plate portions respectively connected to the two sides of the first plate portion, and two foldable fourth plate portions respectively connected to the two sides of the second plate portion, the third plate portions respectively connected to the fourth plate portions; and a foldable connecting area connecting the base and the cover, the cover foldable relative to the base around the connecting area;

wherein when the multifunctional case is in a first configuration, the cover faces the front surface of the base and the electronic device is covered by the cover;

when the multifunctional case is in a second configuration, the cover is folded around the connecting area to face the back surface of the base and the electronic device is exposed for use from the front surface;

when the multifunctional case is in a third configuration, the connecting area and the first through fourth plate portions can be folded to support the base in a slanted orientation, with the second plate portion held between the latching portion and the back surface of the base, so that the electronic device is supported in a slanted position.

2. The multifunctional case as claimed in claim 1, wherein each of the first plate portion and the second plate portion is isosceles trapezoid shaped and has a first folding area between them, the first plate portion can be folded relative to the second portion along the first folding area.

3. The multifunctional case as claimed in claim 2, wherein the first plate portion has an upper margin and a bottom margin parallel with the upper margin, the upper margin is adjacent to a side of the first folding area and the bottom margin is adjacent to a side of the connecting area.

4. The multifunctional case as claimed in claim 2, wherein the second plate portion has an upper edge and a bottom edge parallel with the upper edge, the upper edge is adjacent to the side of the first folding area opposite to the upper margin, the bottom edge has the same length with the connecting area and is located at a side of the cover.

5. The multifunctional case as claimed in claim 1, wherein the two third plate portions are triangular, each of the third plate portions correspondingly forms a second folding area connecting to the first plate portion, and the third plate portions can be folded relative to the first plate portion along the second folding area.

6. The multifunctional case as claimed in claim 1, wherein the two fourth plate portions are also triangular, each fourth plate portion correspondingly forms a third folding area with the second plate portion, and the fourth plate portion can be folded relative to the second plate portion along the third folding area.

7. The multifunctional case as claimed in claim 1, wherein each fourth plate portion forms a fourth folding area with a corresponding third plate portion, and the fourth plate portion can be folded relative to the corresponding third plate portion along the fourth folding area.

8. A multifunctional case for receiving or supporting a portable electronic device, comprising:

a base defining a receiving space in a front surface for receiving the electronic device and having a latching portion on a back surface;

a cover including a foldable first plate portion connected to the base, a foldable second plate portion connected to the first plate portion, two foldable third plate portions respectively connected to the two sides of the first plate portion, and two foldable fourth plate portions respectively connected to the two sides of the second portion, the third plate portions respectively connected to the fourth plate portions; and a foldable connecting area connecting the base and the cover;

wherein when the multifunctional case is in a first configuration, the cover faces the front surface of the base and the electronic device is covered by the cover;

when the multifunctional case is in a second configuration, the cover is folded around the connecting area to face the back surface of the base and the electronic device is exposed for use from the front surface;

when the multifunctional case is in a third configuration the connecting area, and the first through fourth plate portions can be folded to support the base in a slanted orientation, with the second plate portion held between the latching portion and the back surface of the base, so that the electronic device is supported in a slanted position.

9. The multifunctional case as claimed in claim 8, wherein the cover has substantially the same size with the base.

10. The multifunctional case as claimed in claim 8, wherein each of the first plate portion and the second plate portion is isosceles trapezoid shaped and has a first folding area between them, the first plate portion can be folded relative to the second portion along the first folding area.

11. The multifunctional case as claimed in claim 10, wherein the first plate portion has an upper margin and a bottom margin parallel with the upper margin, the upper margin is adjacent to a side of the first folding area and the bottom margin is adjacent to a side of the connecting area.

12. The multifunctional case as claimed in claim 10, wherein the second plate portion has an upper edge and a bottom edge parallel with the upper edge, the upper edge is adjacent to the side of the first folding area opposite to the upper margin, the bottom edge has the same length with the connecting area and is located at a side of the cover.

13. The multifunctional case as claimed in claim 8, wherein the two third plate portions are triangular, each of the third plate portions correspondingly forms a second folding area connecting to the first plate portion, and the third plate portions can be folded relative to the first plate portion along the second folding area.

14. The multifunctional case as claimed in claim 8, wherein the two fourth plate portions are also triangular, each fourth plate portion correspondingly forms a third folding area with the second plate portion, and the fourth plate portion can be folded relative to the second plate portion along the third folding area.

15. The multifunctional case as claimed in claim 8, wherein each fourth plate portion forms a fourth folding area with a corresponding third plate portion, and the fourth plate portion can be folded relative to the corresponding third plate portion along the fourth folding area.

16. A multifunctional case for receiving or supporting a portable electronic device, comprising:

a base having a front surface and a back surface, the front surface defining a receiving space for receiving the electronic device;

a main connecting area; and a cover foldable relative to the base around the main connecting area, the cover including:

a first plate portion connected to the main connecting area;

a second plate portion connected to the first plate portion with a first connecting area;

two third plate portions respectively connected to the two sides of the first plate portion with two second connecting areas; and two fourth plate portions respectively connected to two sides of the second plate portion with two third connecting areas, each third plate portion connected to each fourth plate portion with a fourth connecting area;

wherein when the electronic device is not in use, the cover faces the front surface and covers the receiving space to protective the electronic device on the base;

when the electronic device is in use, the cover is folded around the main connecting area to face the back surface, the electronic device is exposed for use from the front surface, the first plate portion, the second plate portion, the two third plate portions and the fourth plate portions remain an unfolded state;

when the electronic device is reviewed in a slanted orientation, the second plate portion is folded relative to the first plate portion along the first folding area, the third plate portions are folded towards the first plate portion along the second folding areas and abut against the first plate portion, the fourth plate portions are folded towards the second plate portion along the third folding areas to allow the third plate portions and the fourth plate portions to cooperatively support the second plate portion, with the second plate portion held on the back surface of the base.

17. The multifunctional case as claimed in claim 16, wherein the back surface has a latching portion, the second plate portion is held by the latching portion on the back surface.

* * * * *